US006102302A

United States Patent [19]

Nishimura

[11] Patent Number: 6,102,302

[45] Date of Patent: Aug. 15, 2000

[54] INJECTOR

[75] Inventor: Terukazu Nishimura, Fujisawa, Japan

[73] Assignee: Isuzu Motors Limited, Tokyo, Japan

[21] Appl. No.: 09/343,638

[22] Filed: Jun. 30, 1999

[30] Foreign Application Priority Data

Jul. 6, 1998 [JP] Japan ..... 10-190344

[51] Int. Cl.[7] ..... F02M 47/00

[52] U.S. Cl. ..... 239/96; 239/124; 239/533.2; 239/533.9

[58] Field of Search ..... 239/533.2, 533.3, 239/533.8, 533.9, 533.12, 96, 88, 124

[56] References Cited

U.S. PATENT DOCUMENTS

| | | | |
|---|---|---|---|
| 4,948,049 | 8/1990 | Brisbon et al. | 239/96 X |
| 5,556,031 | 9/1996 | Cooke et al. | 239/124 |
| 5,860,597 | 1/1999 | Tarr | 239/124 |

FOREIGN PATENT DOCUMENTS

| | | | |
|---|---|---|---|
| 3-965 | 1/1991 | Japan | F02M 47/00 |
| 9-32680 | 2/1997 | Japan | F02M 47/00 |
| 9-32682 | 2/1997 | Japan | F02M 47/00 |
| 10-77924 | 3/1998 | Japan | F02M 51/00 |

*Primary Examiner*—Lesley D. Morris

*Attorney, Agent, or Firm*—McCormick, Paulding & Huber LLP

[57] ABSTRACT

A fuel injector (1) including a nozzle body (3) and a needle valve (4) liftably received in a nozzle body hole (21, 34) such that fuel flows to injection openings (16) of the nozzle body through a clearance between the nozzle body hole and needle valve. The clearance includes a larger clearance portion (37) and a smaller clearance portion (38) in series in a fuel flowing direction. The needle valve (4) has a collar (20) to almost plug the larger clearance portion (37) and a throttled fuel passage (22) is formed in the collar (20). Since the collar transversely extends in the larger clearance segment, it has a relatively large area subjected to the fuel pressure. Fuel pressure acts on this large area so that a large pressure difference is obtained across the collar during needle valve opening. Thus, it is possible to close the needle valve at a high speed.

20 Claims, 6 Drawing Sheets

A-A CROSS SECTION

A-A CROSS SECTION

INJECTOR

BACKGROUND OF THE INVENTION

1. Field of the Invention

The present invention relates to an injector for fuel injection suitable for a vehicle engine such as a diesel engine.

2. Description of the Related Art

In the fields of diesel engines and direct injection type gasoline engines, a common rail fuel injection apparatus is known to be advantageous to pulverization of fuel spray and high pressure injection. One example of the common rail fuel injection apparatuses is disclosed in the pending U.S. patent application Ser. No. 09/136,078 which is owned by the present assignee. In general, the common rail fuel injection apparatus has a common rail (accumulation chamber) for temporarily storing a fuel which has been pressurized by a high pressure pump. The fuel is injected into cylinders of an engine (or combustion chambers) in a predetermined amount at a time from an injector at a predetermined timing.

The injector generally has a plurality of injection openings (fuel spray outlets) at a lower end thereof which are opened and closed by a needle valve moving up and down inside an injector's body (nozzle body). A spring is also received in the injector body to bias the needle valve in a closing direction (downward direction). The needle valve is immersed in the high pressure fuel (i.e., the needle valve would float in a fuel pool if no downward force acts), and a downward spring force is applied to the needle valve so that a lower end of the needle valve is forced to contact a valve seat so as to close the injection openings of the injector. A downward fuel pressure applied on an upper end of the needle valve is controlled by a pressure control chamber (balance chamber). By appropriately leaking a high pressure fuel from the pressure control chamber, the pressure balance relative to the needle valve is lost so that the needle valve is caused to ascend and therefore the injection openings open. This type of injector is disclosed in, for example, Japanese Patent Application Laid-Open Publication Nos. 10-77924, 9-32680 and 9-32682.

The needle valve is received in a hole or bore formed in a nozzle body of the injector such that it can move up and down. The high pressure fuel fed from the common rail flows through a cylindrical clearance between the nozzle body hole and the needle valve and reaches the injection openings of the injector.

Japanese Patent Application Laid Open Publication No. 3-965 also discloses the common rail injector. In this publication, the clearance between the nozzle body hole and the needle valve is made narrower. In other words, this clearance is throttled. With this modification, the fuel pressure downstream of this throttling portion becomes lower than that upstream of the throttling portion when the fuel is injected. Using this pressure difference, a downward force which acts in the valve closing direction is also applied to the needle valve during fuel injection (referred to as "additional downward force"). Therefore, it is possible to close the needle valve at a very high speed upon completion of fuel injection by combination of the spring force and the additional downward force. This improves response and enables use of a relatively weak spring. Accordingly, the valve opening speed is also raised.

However, this arrangement throttles the small clearance in the vicinity of the injection openings (nozzle outlets) to obtain a desired pressure difference. Consequently, it is difficult to obtain a sufficient valve closing force. In general, the larger the area subjected to the fuel pressure, the larger the valve closing force under the same pressure difference. If the small clearance is throttled, a large pressure application area is not obtained. Thus, a large valve closing force does not result.

SUMMARY OF THE INVENTION

An object of the present invention is to provide a fuel injector which can produce a large valve closing force.

Another object of the present invention is to provide a fuel injector which can close the needle valve upon completion of fuel injection at a high speed and high response.

Still another object of the present invention is to provide a fuel injector which can promptly cut off the fuel upon completion of injection.

Yet another object of the present invention is to provide a fuel injector which does not require severe machining accuracy, has a simple structure and is manufactured at a low cost.

Another object of the present invention is to provide a fuel injector which can stabilize fuel injection (particularly an amount of fuel to be injected) and reduce variation or fluctuation in common rail pressure sensing.

According to one aspect of the present invention, there is provided a fuel injector including a nozzle body and a needle valve received in a nozzle body hole such that it is moved up and down therein, with fuel flowing to downstream exits (injection openings) of the nozzle body through a clearance between the nozzle body hole and the needle valve, characterized in that the clearance includes a larger clearance segment and a smaller clearance segment in series in a fuel flowing direction, the needle valve has a collar to almost plug the larger clearance segment, and a throttled passage is formed in or by the collar such that some of the fuel can flow to the smaller clearance segment through the collar in a restricted manner. The collar transversely extends in the larger clearance segment so that it has a relatively large area subjected to fuel pressure. Since the fuel pressure acts on this large area, a large pressure difference is obtained across the collar during needle valve opening. Thus, it is possible to close the needle valve at a high speed.

It is preferred that a pressure control chamber is also formed in the nozzle body to control the fuel pressure to be applied onto the needle valve. The collar may preferably be located close to the small clearance segment. The nozzle body may include an upper body and a lower body, and the large clearance segment may be formed in the upper body and the small clearance segment may be formed in the lower body. The collar may be a ring-shaped member press fit over the needle valve. The outer periphery of the collar may be cut out along the entire periphery and the throttled passage for the fuel may be defined by this annular cutout. Alternatively, the collar may contact the nozzle body hole along its entire periphery and be slidable relative to the nozzle body hole, and at least one opening may be formed in the collar such that the fuel is only allowed to pass the collar through this opening. A spring may be located in the large clearance segment to bias the needle valve in the valve closing direction. The collar may also serve as a support for this spring. The collar may have a two-piece structure. The collar may include a stop fit on the needle valve and spaced from the nozzle body hole wall, and a presser biased against the upper face of the stop by the spring and slidable relative to the nozzle body hole wall. A through hole may be formed in the presser, and this through hole may serve as the throttled passage. An exit of this through hole may open to the space between the stop and the nozzle body hole wall.

According to a second aspect of the present invention, there is provided a fuel injector including a nozzle body, a needle valve liftably received in a nozzle body hole, and a clearance formed between the needle valve and the nozzle body hole, with fuel flowing to injection openings of the nozzle body through the clearance, characterized in that the clearance has a larger clearance portion and a smaller clearance portion in series, a clogging member is provided in the larger clearance portion, a throttled passage is formed in or defined by the clogging member for passage of the fuel, and a flange is provided on the needle valve such that the fuel passing through the throttled passage collides on the flange. Since the fuel accelerated by the throttled passage collides on the flange during valve opening, a large valve closing force is obtained and therefore the needle valve can be closed at a high speed.

A pressure control chamber is preferably provided in the nozzle body for controlling fuel pressure to be applied to the needle valve. The throttled passage may be situated in the vicinity of the smaller clearance portion. The nozzle body may include an upper body and a lower body, the larger clearance portion may be formed in the upper nozzle body and the smaller clearance portion may be formed in the lower nozzle body, and the clogging member and flange may be both located in the larger clearance portion near the smaller clearance portion. The clogging member may be a ring-shaped member which is press fit in the nozzle body hole and the flange may also be a ring-shaped member which is press fit on the needle valve. The clogging member may be spaced from the needle valve in a radial direction of the needle valve so that an annular space is formed between the clogging member and the needle valve and this annular space serves as the throttled passage. The flange may be an annular member located closely downstream of the throttled passage. Alternatively, the clogging member may be fit in the larger clearance portion and slidable relative to the needle valve, the throttled passage may be a through hole formed in the clogging member, and an exit of the through hole may face the flange. A stepwise recess may be formed in a lower end of the larger clearance portion by further enlarging a diameter of the larger clearance portion, and a sleeve may be placed in the recess such that it is not movable in the recess in an axial direction of the nozzle body hole. The sleeve may have an extension projecting radially inward toward the needle valve. The nozzle body may include an upper body and a lower body coaxially aligned by a guide sleeve. The guide sleeve may also serve as the clogging member. A spring may be placed in the larger clearance portion for biasing the needle valve in a closing direction.

DETAILED DESCRIPTION OF THE INVENTION

Now, embodiments of the present invention will be described with reference to the accompanying drawings.

Figure 1:
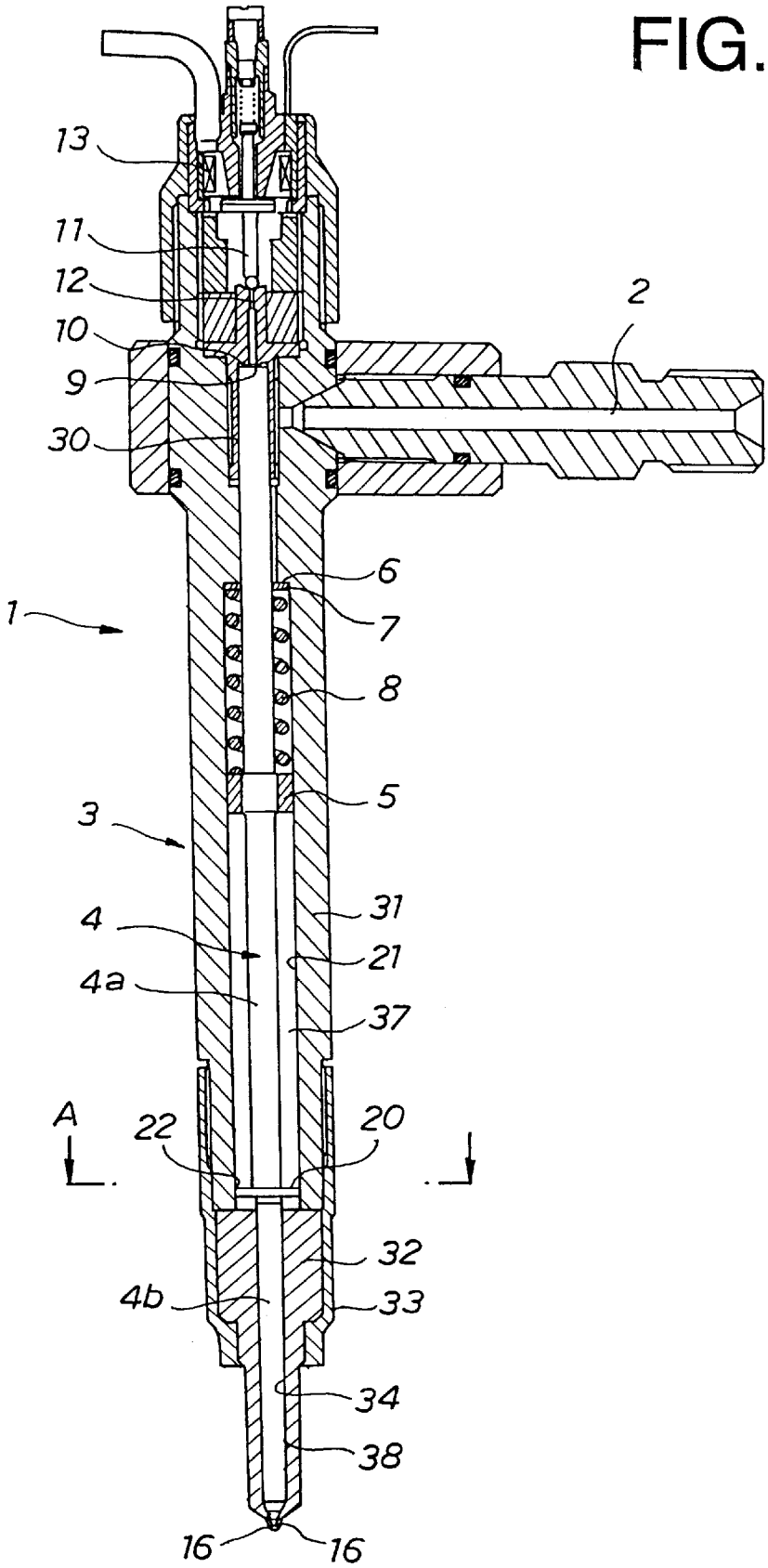
FIG. 1 illustrates a vertical cross sectional view of a fuel injector according to one embodiment of the present invention.

Referring to FIG. 1, a fuel injector 1 of the invention includes a nozzle body 3 of which vertical hole is filled with a fuel supplied from a fuel pipe 2. A high pressure fuel is supplied to the fuel pipe 2 from a common rail (not shown). This high pressure fuel flows to a plurality of injection openings 16 formed at a lower end of the nozzle body 3 through the vertical hole. A needle valve 4 is movably received in the nozzle body hole in such a manner that the needle valve 4 is immersed in the high pressure fuel. The needle valve 4 can move up and down in the illustration. The needle valve 4 is biased in a closing direction by a spring 8 interposed between a spring support 5 press fitted on the needle valve 4 and an upper spring seat 7 placed on a step 6 formed in the nozzle body 3. Openings (not shown) are formed in the spring support 5 and spring seat 7 for passage of the fuel.

A top end face 9 of the needle valve 4 is subjected to a pressure control chamber 10, and a high pressure fuel is always introduced to the pressure control chamber 10 from the fuel pipe 2 through a clearance between the needle valve upper portion and a holding sleeve 30. It should be noted that this clearance is small sufficient to define a predetermined throttling. The fuel in the pressure control chamber 10 is selectively allowed to leak from a leak hole 12 by a valve 11. The valve 11 is normally biased downward by a spring or the like to close the leak hole 12 and maintain the fuel pressure in the control chamber 10. When the valve 11 is lifted up by an electromagnetic solenoid valve 13, it opens the leak hole 12 to allow the fuel to leak from the pressure control chamber 10.

Figure 9:
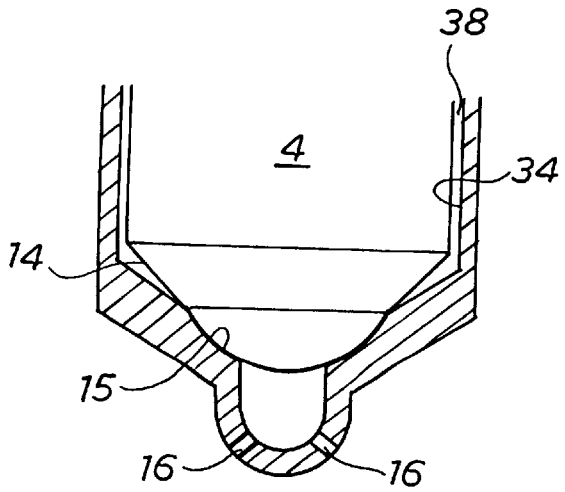
FIG. 9 illustrates an elevational cross section of the injector near a lower end of the needle valve shown in FIG. 1.

When the valve 11 is closed, the fuel pressure directed downward or in the closing direction acts on the top end face 9 of the needle valve 4, so that the needle valve 4 is pressure balanced (upward and downward fuel pressures acting on the needle valve 4 are the same) and therefore the needle valve 4 is moved downward by the force of the spring 8. In this situation, as illustrated in FIG. 9, the needle valve 4 seats on a valve seat 15 and closes the injection openings 16. Therefore, this is a non-injection state. Specifically, when the needle valve 4 is at the closing position as shown in FIG. 9, a conical surface 14 is only applied an upward fuel pressure among a lower end portion of the needle valve 4. No fuel pressure acts on a lowermost hemispherical surface of the needle valve so that a downward pressure rather prevails as a whole.

On the other hand, when the valve 11 is opened, the fuel pressure applied onto the top 9 of the needle valve 4 is reduced. Thus, the pressure balance is lost and the needle valve 4 ascends. The lower end of the needle valve 4 therefore leaves the valve seat 15, thereby opening the injection openings 16. In this manner, the fuel injection takes place.

Referring back to FIG. 1, the needle valve 4 is a single piece element, and its upper portion 4*a* is slightly larger than the lower portion 4*b* in diameter.

The nozzle body 3 includes an upper cylindrical body 31 and a lower cylindrical body 32 coupled by a retaining nut 33. A large diameter hole 21 is formed in the upper nozzle body 31 and a small diameter hole 34 is coaxially formed in the lower nozzle body 32. The upper needle valve segment 4*a* is received in the larger hole 21 and the lower valve segment 4*b* is generally received in the smaller hole 34. The larger and smaller holes 21 and 34 define a single continuous nozzle body hole.

An upper cylindrical clearance 37 is formed between the upper hole 21 and the upper needle valve segment 4*a*, and a lower clearance 38 is formed between the lower hole 34 and the lower needle valve segment 4*b*. The fuel from the fuel pipe 2 flows through these clearances 37 and 38 subsequently and reaches the injection openings 16. A diametrical size of the lower clearance 38 is only sufficient for passage of the fuel, but that of the upper clearance 37 is large enough to accommodate the coil spring 8. Therefore, the upper clearance 37 defines the larger clearance portion of the invention and the lower clearance 38 the smaller clearance portion. It should be noted that a clearance corresponding to the lower clearance 38 is throttled in Japanese Patent Application Laid Open Publication No. 3-965.

Figure 4:
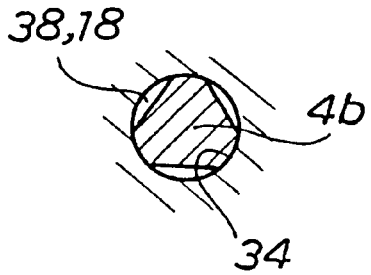
FIG. 4 a transversal cross sectional view of a lower half of a needle valve shown in FIG. 1.

As illustrated in FIG. 4, the lower half 4*b* of the needle valve is a generally equilateral triangle in its transversal cross section. This cross section may be formed by cutting a circular cross section having the same diameter as the lower hole 34 at three sides equally. Therefore, the lower clearance 38 is defined by the cutouts 18 and the fuel is allowed to flow to the injection holes 16 through these cutouts 18. In this manner, strict machining accuracy is not required between the lower needle valve segment 4*b* and the lower hole 34 in order to insure passage of the fuel. This contributes to easier manufacturing and cost reduction. It should be noted that the lower needle valve segment 4*b* may have a circular cross section like an ordinary needle valve and an annular gap 38 may be formed around it.

Referring back to FIG. 1 again, the needle valve 4 has a collar 20 to almost close the upper clearance 37. In the illustration, the collar 20 is situated immediately above (or upstream of) the lower nozzle body 32 inside the upper clearance 37, i.e., the collar 20 is located just upstream of the lower clearance 38. It can also be said that the collar 20 is positioned at the connection between the upper and lower needle valve segments 4*a* and 4*b*. The collar 20 is a disc-shaped member having an opening at its center for press fitting on the needle valve 4.

Figure 2:
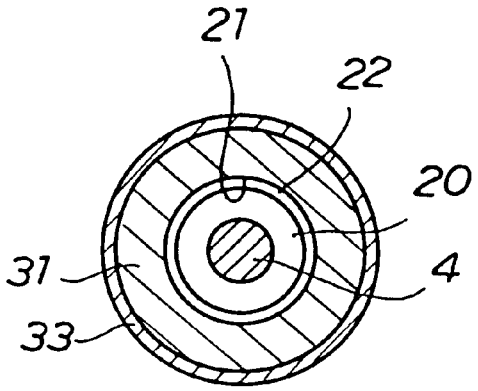
FIG. 2 is a cross sectional view taken along the line A—A of FIG. 1 to particularly illustrate a collar and a throttled fuel passage.
Figure 3:
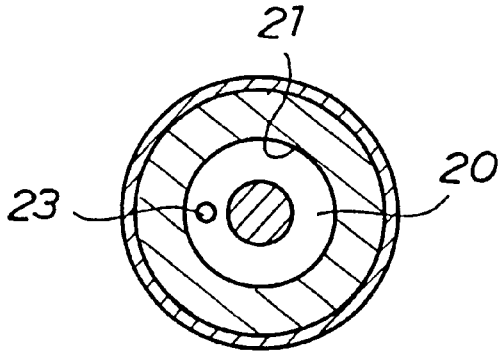
FIG. 3 is a view similar to FIG. 2, illustrating another example of the collar and throttled fuel passage.

In FIG. 2, illustrated is the detail of the collar 20. The collar 20 is reduced in diameter relative to the surrounding inner wall of the upper hole 21, thereby forming an annular throttled passage 22 around the collar 20. The fuel flows through this restricted passage 22 to go further downward. It should be noted as illustrated in FIG. 3 that the diameter of the collar 20 may be the same as the upper hole 21 and an opening 23 may be formed in the collar 20 to only allow passage of the fuel through this opening 23. This opening 23 will function as the throttling passage 22 of FIG. 2, and the collar 20 may have a construction like as a shaft seal. It should also be noted that the number of the opening 23 may be two or more.

When the needle valve 4 is moved up to execute fuel injection, the fuel is throttled by the restricted passage 22 and then injected. Thus, the fuel pressure on the downstream side becomes lower than the upstream side in the nozzle body hole. This pressure difference is utilized to apply a force on the needle valve 4 in a valve closing direction. Therefore, it is possible to close the needle valve 4 at high response with a high speed upon completion of fuel injection. Prompt cutting off of the fuel is accordingly achieved.

In the illustrated embodiment, since the collar 20 is positioned near the lower clearance 38 as close as possible, the volume below the throttled passage 22 is made minimum. Therefore, it is feasible to quickly create the pressure difference across the collar 20. This improves the response.

The collar 20 is located in the upper larger clearance 37 so that an area presented to the fuel pressure is larger than the conventional arrangement and a large valve closing force is obtained. Specifically, if the valve closing force is F, an area exposed to fuel pressure is A and the pressure difference is ΔP, then the following equation is obtained:

$$F = A \times \Delta P$$

The larger the pressure exposed area, the greater the valve closing force under the same pressure difference. Since the pressure exposed area is larger than the conventional arrangement, a larger valve closing force is acquired and the response is improved. For example, if the radius of the pressure exposed area is made twice, the valve closing force becomes four times. From another point of view, a smaller pressure difference is needed to obtain the same valve closing force so that a throttling resistance can be reduced.

One of modifications possible to the embodiment shown in FIG. 1 will be described in reference to FIG. 10. The same reference numerals are allotted to similar elements and their description will be omitted.

Figure 10:
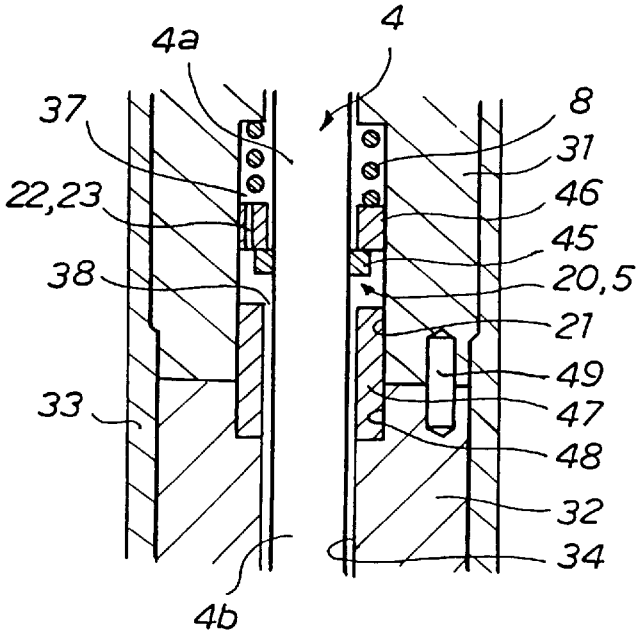
FIG. 10 illustrates a modification made to the first embodiment shown in FIG. 1.

Referring to FIG. 10, the collar 20 also serves as the spring seat 5. The length of the upper hole 21 in the nozzle body 3 is considerably reduced, and the spring 8 abuts the collar 20 to bias the needle valve 4 in the valve closing direction. The collar 20 is situated just above the lower clearance 38 like the previous embodiment.

Centering between the upper nozzle body 31 and lower nozzle body 32 is determined by a guide sleeve 47 and alignment in the circumferential direction between these nozzle bodies is determined by a positioning pin 49. The guide sleeve 47 is press fit in the large diameter hole 21 of the upper nozzle body 31 and an enlarged portion 48 formed at the upper end of the smaller hole 34 of the lower nozzle body 32. The upper and lower needle valve segments 4*a* and 4*b* have the same circular cross section (same diameter). The lower cylindrical clearance 38 is formed inside the guide sleeve 47 and lower nozzle body 32.

The collar 20 has a two-piece structure. Specifically, the collar 20 includes a ring-shaped stop 45 press fit over the needle valve 4 and a ring-shaped presser 46 pushed against the upper face of the stop 45 by the spring 8. The stop 45 has a diameter which does not clog up the upper clearance 37 so that the outer periphery of the stop 45 is spaced from the inner wall of the upper hole 21 to allow passage of the fuel. The presser member 46 is slidable relative to the inner wall of the upper hole 21 but there is no clearance for passage of fuel between the presser member 46 and the upper hole 21. The fuel rather flows in the clearance between the presser member 46 and the needle valve 4. It should be noted, however, that the presser member 46 is forced against the upper face of the stop member 45, so that the contact between the presser member 46 and the stop member 45 serves as a seal which prohibits passage of the fuel. In sum, the presser member 46 and stop member 45 cooperate to clog up the upper clearance 37. These two members 45 and 46 move up and down together upon ascending and descending of the needle valve 4.

A throttling opening 23 is formed in the presser member 46 to define a throttled passage 22. The fuel is allowed to pass through this passage 22, thereby creating a pressure difference across the collar 20 and obtaining a larger valve closing force. The exit of the throttled passage 22 opens to the clearance between the stop member 45 and the upper nozzle body hole 21. It should be noted that the outer diameter of the presser member 46 may be reduced to be spaced from the inner wall of the upper nozzle body hole 21 so as to form an annular throttled passage 22.

In this embodiment, the collar 20 also serves as the spring support 5 so that the number of parts to construct the fuel injector 1 is reduced. Thus, the fuel injector will have a simpler structure and be manufactured at a lower cost. The stop 45 is only needed to be manufactured at high precision at its inner periphery since this portion is fit on the needle valve 4, and the presser 46 is manufactured at high accuracy at its outer periphery since this portion is in slide contact with the wall of the nozzle body hole 21. In the first embodiment (FIG. 1), the collar 20 is manufactured at high accuracy at both its outer and inner peripheries. As compared with the collar 20 of the first embodiment, the collar 20 of this modification can be fabricated easier.

Pressure pulsation occurs in an area downstream of the throttled hole 23 because of repeatedly performed fuel injection. However, this pressure pulsation is buffered by micro-vibrations of the presser 46. As a result, the amount of fuel injection is stabilized and fluctuation in sensing the common rail pressure is reduced.

Figure 5:
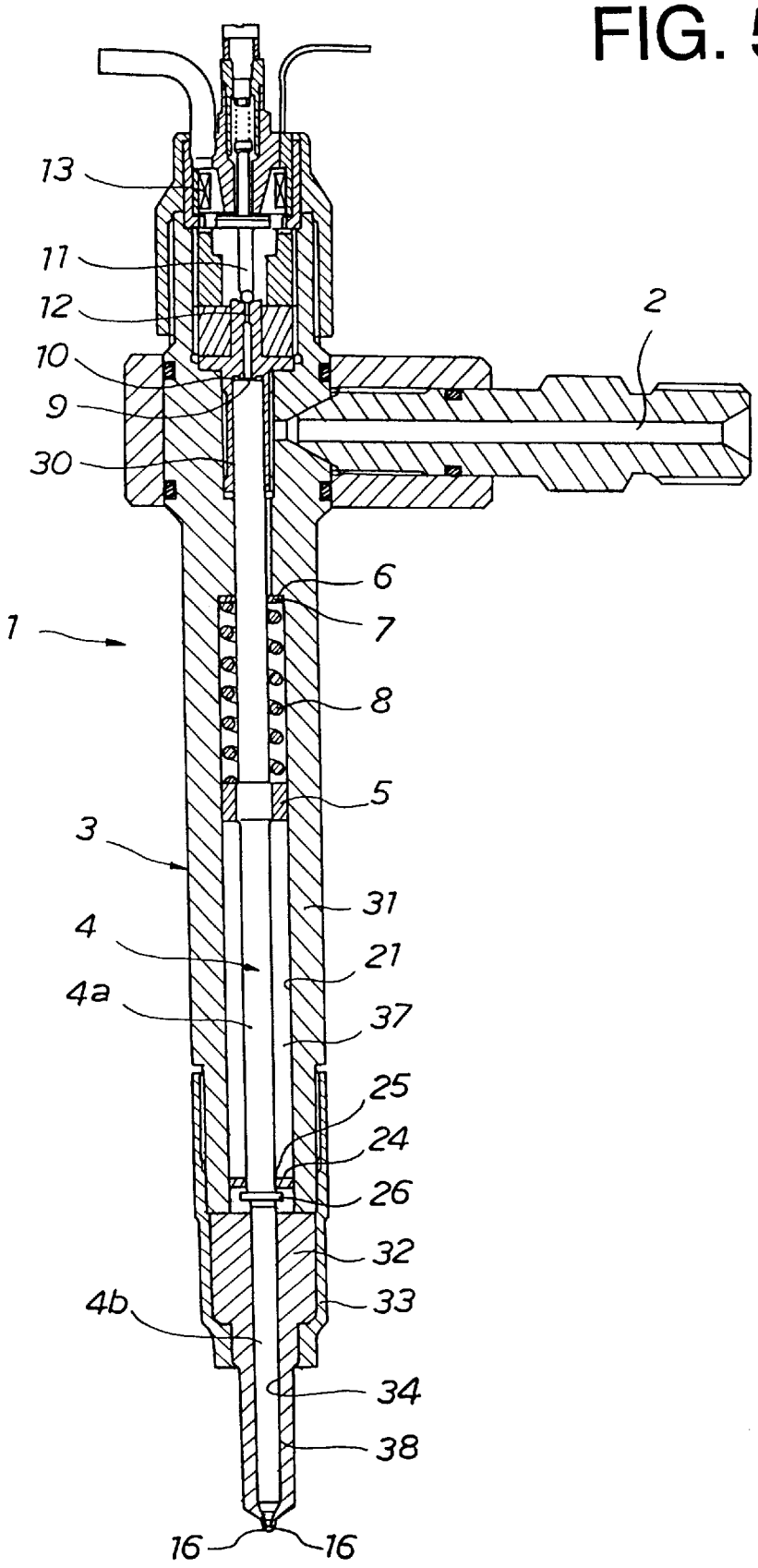
FIG. 5 illustrates an elevational cross section of a fuel injector according to another embodiment of the present invention.

Referring now to FIG. 5, illustrated is another embodiment of the present invention. The same reference numerals are used to indicate same or similar elements in the following description and associated drawings.

Figure 6:
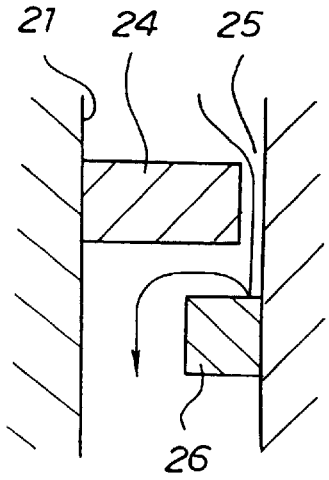
FIG. 6 illustrates an enlarged view of a major portion of the injector shown in FIG. 5.

A ring-shaped collar 24 is press fit in the upper nozzle body hole 21 to extend in most of the transversal area of the upper clearance 37. As illustrated in FIG. 6, the inner diameter of the collar 24 is slightly larger than the diameter of the needle valve 4 so that a small gap is left which defines a throttled passage 25. A ring-shaped flange 26 is press fit on the needle valve 4 such that the fuel which has passed the throttled passage 25 collides with the flange 26. The upper and lower ring-shaped members 24 and 26 overlap and directs the fuel in the radiant direction after collision against the lower ring-shaped member 26 as indicated by the arrow in FIG. 6. It should be noted that the throttled passage 25 may be an opening formed in the upper ring member 24 as shown in FIG. 3.

In this embodiment, the fuel is accelerated as it passes through the throttled passage 25, and the accelerated fuel is guided to hit the collar 26 so as to apply the closing force to the needle valve 4. In other words, the velocity energy of the high speed fuel is utilized to increase the valve closing force. In this connection, the collar 26 has a particular configuration (i.e., a ring shape) which is advantageous to receive the velocity energy of the fuel flowing from the annular passage 25. It should be noted that if the throttled passage 25 is a small circular opening, like the one shown at 23 in FIG. 3, the collar 26 may only extend downstream of the exit of this opening.

In this embodiment, since the collar 26 is positioned in the upper large clearance 37, an area to which the fuel pressure applies is large and therefore a large valve closing force is obtained.

Figure 7:
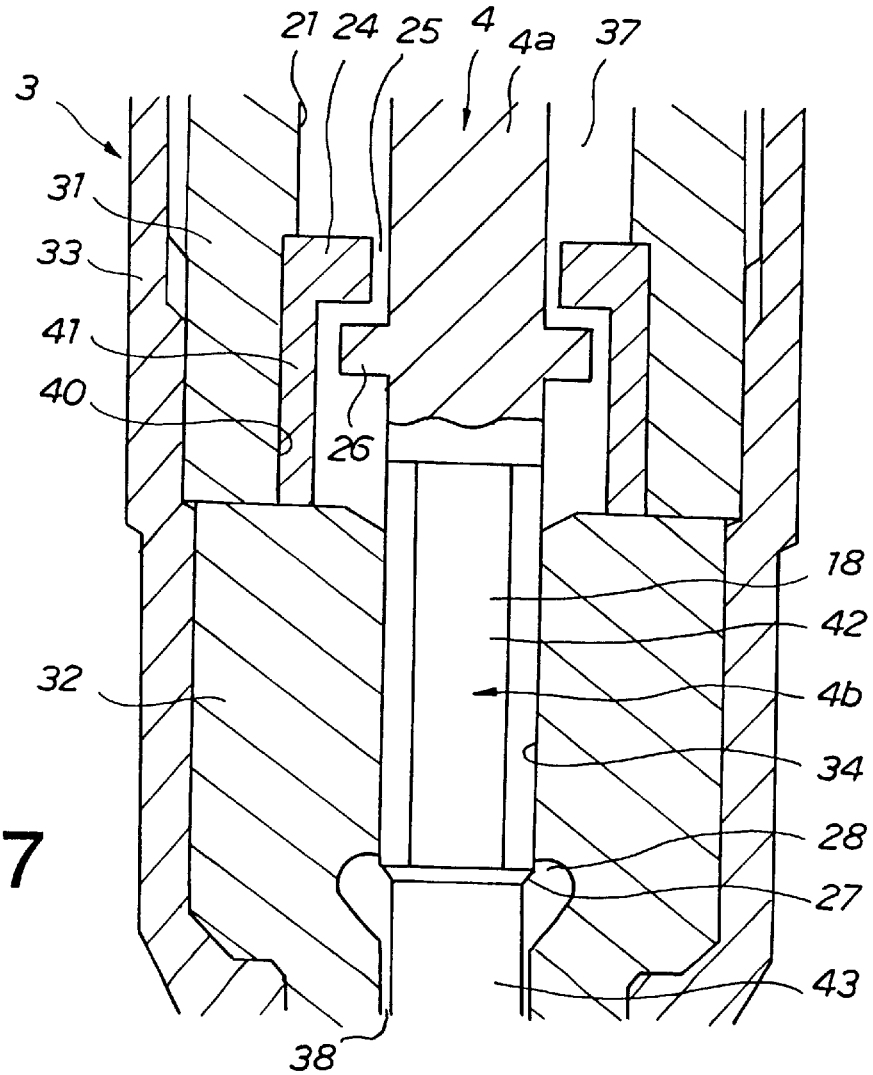
FIG. 7 is a fragmentary enlarged vertical cross sectional view illustrating another injector according to the present invention (modification to the embodiment shown in FIG. 5)

Various modifications may be made to the embodiment shown in FIGS. 5 and 6. For example, as illustrated in FIG. 7, the lower end of the upper nozzle body hole 21 is slightly enlarged in diameter to form an enlarged portion 40 which accommodates a sleeve 41 in a press fit manner. The upper end of the sleeve 41 is bent toward the center (or radially inward) to form the ring-shaped extension 24. Positioning of the radial extension 24 in the axial direction of the needle valve 4 is easier as compared with the FIG. 6 embodiment. The collar 26 is integrally formed on the needle valve 4. The lower needle valve segment **4*b* has an upper section 42 having a substantially equilateral triangular cross section as shown in FIG. 4 and a reduced lower section 43 having a generally circular cross section. The transitional portion between the upper and lower sections 42 and 43 is defined by a tapered surface 27 which is exposed to a fuel pool 28 formed in the lower nozzle body hole 34. Therefore, an upward fuel pressure also acts on the needle valve 4 at the tapered surface 27**.

Figure 11:
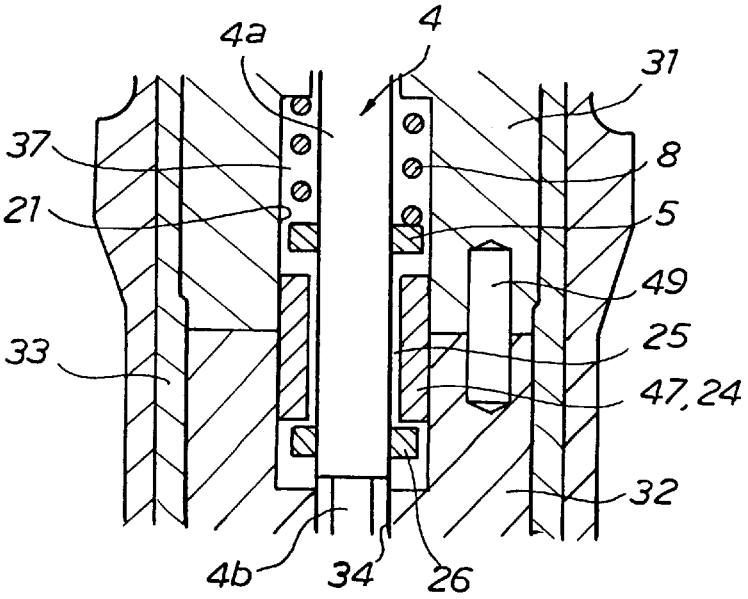
FIG. 11 illustrates another modification made to the second embodiment shown in FIG. 5.

Another modification may also be possible as illustrated in FIG. 11. The guide sleeve 47 of FIG. 10 is also used as the ring-shaped member 24 of FIG. 6. Therefore, the number of the parts is reduced, i.e., a separate ring-shaped member 24 is not needed. The structure of the injector 1 is accordingly simplified and manufactured at a lower cost.

Figure 8:
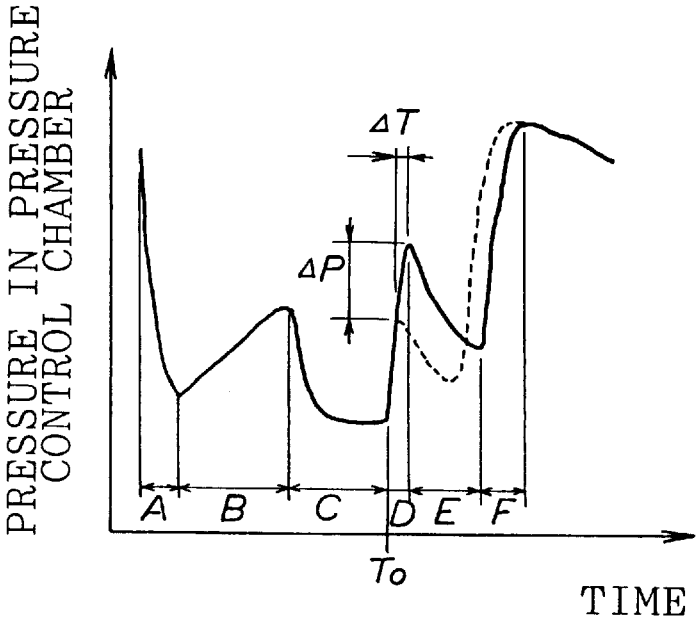
FIG. 8 is a diagram showing effects of the invention.

Referring to FIG. 8, illustrated is a diagram showing effects of the present invention. The vertical axis indicates the pressure in the pressure control chamber 10 and the horizontal axis indicates the time. The description in connection with FIG. 8 applies to all of the foregoing embodiments.

In the section A, the electromagnetic solenoid 13 is turned on, the valve 11 is lifted to cause fuel leakage, and therefore the pressure of the pressure control chamber 10 (referred to as "control chamber pressure") drops. In the section B, the control chamber pressure rises because the control chamber volume is reduced upon lifting of the needle valve 4. However, the fuel continuously leaks so that the control chamber pressure drops in the subsequent section C after the needle valve 4 reaches the uppermost position.

The solenoid valve 13 is turned off at the time To, and the valve 11 is closed and the fuel leakage is stopped in the section D. As a result, the control chamber pressure increases. In the next section E, the needle valve 4 is lowered and the control chamber volume increases so that the control chamber pressure drops temporarily. In the following section F, however, the control chamber pressure rises after the needle valve 4 is lowered since the fuel is continuously fed into the pressure control chamber 10.

In the present invention, since a valve closing force greater than the conventional arrangement is continuously applied to the needle valve 4 during lifting up of the needle valve 4, it is possible to start lowering of the needle valve 4 after turning off the solenoid valve 13 at a timing earlier by $\Delta T$ from a control chamber pressure lower by $\Delta P$ as indicated by the broken line as compared with the conventional arrangement (solid line). Accordingly, the response after completion of the fuel injection is improved.

It should be noted that the present invention is also applicable to any type of injector other than the above described pressure-balanced type.

This application claims priority of Japanese Patent Application No. 10-190344 filed on Jul. 6, 1998 and the entire disclosure of the above-mentioned Japanese Patent Application is incorporated herein by reference.

What is claimed is:

1. A fuel injector comprising:

a nozzle body having a hole extending therethrough;

at least one injection opening formed at a downstream end of the nozzle body;

a needle valve liftably received in the nozzle body hole;

a clearance formed between the needle valve and the nozzle body hole, with fuel flowing to the at least one injection opening through the clearance, the clearance having a larger clearance portion on an upstream side and a smaller clearance portion on a downstream side in series;

a collar provided on the needle valve for substantially clogging the larger clearance portion; and a throttled passage formed in or defined by the collar for passage of the fuel.

2. The fuel injector of claim 1 further including a pressure control chamber for controlling fuel pressure to be applied to the needle valve.

3. The fuel injector of claim 1, wherein the throttled passage is situated in the vicinity of the smaller clearance portion.

4. The fuel injector of claim 1, wherein the nozzle body includes an upper body and a lower body, the larger clearance portion is formed in the upper nozzle body and the smaller clearance portion is formed in the lower nozzle body, and the collar is located in the larger clearance portion near the smaller clearance portion.

5. The fuel injector of claim 1, wherein the collar is a ring-shaped member which is press fit on the needle valve.

6. The fuel injector of claim 1, wherein the collar is smaller than the larger clearance portion such that an annular gap is formed between the collar and the nozzle body hole and this annular gap is the throttled passage defined by the collar.

7. The fuel injector of claim 1, wherein the collar is fit in the larger clearance portion and slidable relative to the nozzle body hole, and the throttled passage is a through hole formed in the collar, whereby the fuel is only allowed to pass through the through hole.

8. The fuel injector of claim 1 further including a spring placed in the larger clearance portion for biasing the needle valve in a valve closing direction, and the collar is also used as a spring support.

9. The fuel injector of claim 1, wherein the collar has a two-piece structure.

10. The fuel injector of claim 8, wherein the collar includes a stop press fit on the needle valve and leaving a gap between itself and the nozzle body hole, and a presser biased against an upper face of the stop by the spring and slidable relative to the nozzle body hole, the presser having a through hole which serves as the throttled passage, and an exit of the through hole opening to the gap formed between the stop and nozzle body hole.

11. A fuel injector comprising:

a nozzle body having a hole extending therethrough;

at least one injection opening formed at a downstream end of the nozzle body;

a needle valve liftably received in the nozzle body hole;

a clearance formed between the needle valve and the nozzle body hole, with fuel flowing to the at least one injection opening through the clearance, the clearance having a larger clearance portion and a smaller clearance portion in series in a fuel flow direction;

a clogging member provided in the larger clearance portion;

a throttled passage formed in or defined by the clogging member for passage of the fuel; and a flange provided on the needle valve such that the fuel passing through the throttled passage collides on the flange.

12. The fuel injector of claim 11 further including a pressure control chamber for controlling fuel pressure to be applied onto the needle valve.

13. The fuel injector of claim 11, wherein the throttled passage is situated in the vicinity of the smaller clearance portion.

14. The fuel injector of claim 11, wherein the nozzle body includes an upper body and a lower body, the larger clearance portion is formed in the upper nozzle body and the smaller clearance portion is formed in the lower nozzle body, and the clogging member and flange are both located in the larger clearance portion near the smaller clearance portion.

15. The fuel injector of claim 11, wherein the clogging member is a ring-shaped member which is press fit in the nozzle body hole and the flange is another ring-shaped member which is press fit on the needle valve.

16. The fuel injector of claim 11, wherein the clogging member is spaced from the needle valve so that an annular gap is formed between the clogging member and the needle valve and this annular gap serves as the throttled passage, and the flange is an annular member located closely downstream of the throttled passage.

17. The fuel injector of claim 11, wherein the clogging member is fit in the larger clearance portion and slidable relative to the needle valve, the throttled passage is a through hole formed in the clogging member, and an exit of the through hole is formed to face the flange.

18. The fuel injector of claim 11 further including a recess formed in a lower end of the larger clearance portion by enlarging a diameter of the larger clearance portion and a sleeve placed in the recess such that it is not movable in the recess in an axial direction of the nozzle body hole, and wherein the sleeve has an extension projecting radially inward toward the needle valve.

19. The fuel injector of claim 11 further including a guide sleeve, and wherein the nozzle body includes an upper body and a lower body coaxially aligned by the guide sleeve, and the guide sleeve also serves as the clogging member.

20. The fuel injector of claim 11 further including a spring placed in the larger clearance portion for biasing the needle valve in a valve closing direction.

* * * * *